United States Patent [19]

Keck

[11] 4,442,572

[45] Apr. 17, 1984

[54] CLIP FOR FIXING MALE AND FEMALE PARTS OF GROUND GLASS JOINTS

[76] Inventor: Hermann Keck, Blauenstrasse 13, 4106 Therwil, Switzerland

[21] Appl. No.: 429,863

[22] Filed: Sep. 30, 1982

[30] Foreign Application Priority Data

Oct. 6, 1981 [CH] Switzerland ..... 6405/81

[51] Int. Cl.[3] ..... A44B 21/00

[52] U.S. Cl. ..... 24/562; 24/564

[58] Field of Search ..... 403/405, 155; 24/255 R, 24/257 R, 259 R; 269/268, 274; 223/96

[56] References Cited

U.S. PATENT DOCUMENTS 2,615,238 10/1952 Highwood ..... 269/268
2,924,809 2/1960 Wilson ..... 24/259 R
3,543,355 12/1970 Wyckoff et al. ..... 24/255 R
3,683,462 8/1972 Voigt ..... 24/255 R
4,110,942 9/1978 Slocomb, Jr. ..... 52/397

*Primary Examiner*—W. L. Shedd

*Attorney, Agent, or Firm*—Fleit, Jacobson, Cohn & Price

[57] ABSTRACT

The invention serves to hold together the male and the female parts of ground glass joints.

As can be seen from the FIGS. 1,2 and 3 this new device consists of two rings (1+2) concentrically placed one above the other. Both rings are connected on their outside by three bow-shaped retainers (5).

The two rings (1+2) have one opening (3,4) each on one side. These allow the rings to be slid onto the male and female parts of a glass joint. Both rings then firmly grip the two parts of the joint and hold them together.

8 Claims, 3 Drawing Figures

CLIP FOR FIXING MALE AND FEMALE PARTS OF GROUND GLASS JOINTS

This invention refers to a device in the form of clips for holding together the male and female parts of ground glass joints. These clips consist of 2 rings (1+2) concentrically placed one above the other and connected on the outside by 3 bow-shaped side-pieces (5). Both rings have one opening on one side.

Devices for the connection of male and female parts of ground glass joints already exist. More than 26 years ago small spirals of steel wire were fixed on little glass hooks of the male and female parts in order to hold the joints together. However these glass hooks often broke and then it was impossible to hold the two parts of the joints together. More recently steel wire clips have been used. These have the disadvantage that they scratch the glass and can easily be bent out of shape. In addition it is difficult to apply them to the joints and to remove them.

The submitted device according to claims 1 to 9 does not have the above mentioned disadvantages. Both rings are made of plastic material. They do not have any sharp edges which might scratch the glass. Furthermore they have a degree of elasticity but cannot be bent out of shape. These invented devices can be easily put onto the glass joint with only one hand and then they hold the two parts of the glass joints firmly together. The clips can easily be withdrawn from the joints with only one hand.

In the following the structure of these new clips and the way they work is explained with the help of the enclosed drawings.

Figure 1:
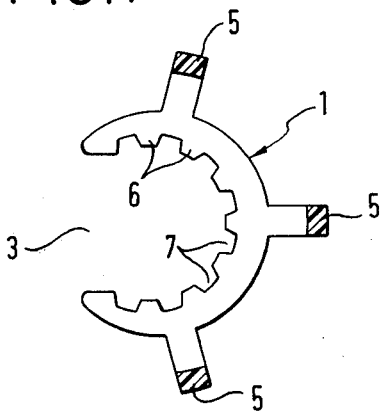
FIG. 1 shows the upper smaller ring (1) from above.
Figure 2:
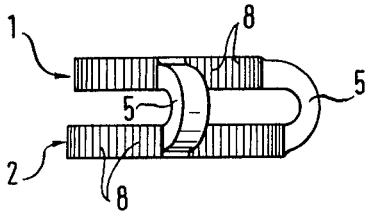
FIG. 2 shows the two rings (1+2) concentrically placed one above the other and connected on the outside by the three bow-shaped retainers (5), viewed from the side.
Figure 3:
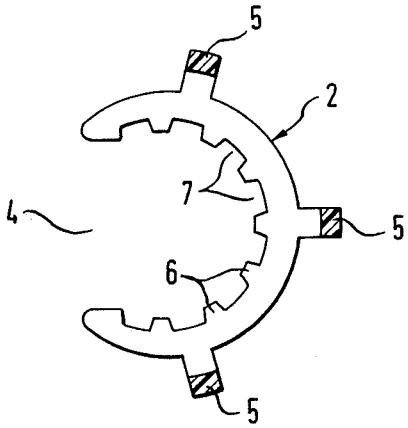
FIG. 3 shows the larger ring (2) from below.

According to FIG. 1 the upper ring (1) has an opening (3) for inserting the male part of the glass joint. This opening covers preferably $\frac{1}{3}$ of the periphery of the ring. Inside each of the rings cams (6) and grooves (7) are provided, thereby decreasing the contact area of the ring with the heated surface of the glass joints and thereby reducing effectively heating and possible softening of the thermoplastic material. The heat, radiating from the heated glass, as well as the hot air can pass through the grooves (7) thereby providing air circulation around this area which hinders overheating of this area. Additionally flexibility of the ring is increased by the grooves thereby resulting in easy handling of the device in use.

As material any plastic material can be used, which has sufficient high temperature stability, preferably in the range of 150° C. and which has as well high modulus of elasticity. Preferred material are polyoxymethylen (POM), polyamide (PA), polycarbonate (PC), polyester (PBTP, PETP), polyphenylenoxid (PPO), polysulfone and polyetherimide.

Especially preferred are polyoxymethylen, for example "delrin", trademark for corresponding product of Dupont with melting point of about 175° C., since this product provides the extraordinarily good combination of temperature stability and elasticity which is needed with respect to the device according to the invention.

Upper ring (1) and lower ring (2) are connected by bow-shaped side-pieces (5); preferably three bow-shaped side-pieces (5) are formed to connect the upper ring (1) and the lower ring (2); preferably three bow-shaped side-pieces (5) are formed and distributed regularily over an angular area of about 120°.

In order to put the clip onto the glass joints one holds the middle curved retainer (5) with two fingers and pushes the two rings (1+2) with their opening in front onto the glass joint. The small ring (1) must grip the upper male part and the larger ring (2) the lower female part of the joint. When the clip is pushed onto the joint, the openings (3+4) between the two ends of each ring are somewhat widened due to the elasticity of the device. In the final position both rings of the clip tightly span around the male and the female parts of the joint and hold them together.

What I claim is:

1. Device for holding together the male and female part of glass joints, consisting of two rings (1+2) concentrically placed one above the other, characterized in that each of the rings has an opening (3+4) at the side which extends entirely through the side of said ring in a direction perpendicular to the centerline axis of said rings and that said rings are connected on the outside by bow-shaped side-pieces (5).

2. Device as claimed in claim 1, characterized in that the diameter of the upper ring (1) is somewhat smaller than the diameter of the lower ring (2).

3. Device as claimed in claim 1, characterized in that the diameter of the upper ring (1) is somewhat smaller than the diameter of the lower ring (2) and that both rings (1+2) show on their inside grooves and cams.

4. Device as claimed in claim 1, characterized in that the diameter of the upper ring (1) is somewhat smaller than the diameter of the lower ring (2) and that both rings have on their outside vertical rills (8) for facilitating handling.

5. Device as claimed in claim 1, characterized in that it is formed in one-piece.

6. Device as claimed in claim 5, characterized in that it is made of a plastic material with sufficient temperature stability of at least 150° C. and a high modulus of elasticity.

7. Device as claimed in claim 6, characterized in that it is made of polyoxymethylen melting within 165° to 175° C.

8. Device as claimed in claim 1, characterized in that it is made of sheet steel being coated with temperature stable plastic material.

* * * * *